US005611183A

United States Patent [19]

Kim

[11] Patent Number: 5,611,183

[45] Date of Patent: Mar. 18, 1997

[54] WALL FORM STRUCTURE AND METHODS FOR THEIR MANUFACTURE

[76] Inventor: Chin T. Kim, 3323 Pearl St., Santa Monica, Calif. 90405

[21] Appl. No.: 473,440

[22] Filed: Jun. 7, 1995

[51] Int. Cl.[6] ..... E04B 2/86; E04B 2/30

[52] U.S. Cl. ..... 52/426; 52/379; 52/570; 52/357; 52/363; 52/358; 52/424

[58] Field of Search ..... 52/309.12, 379, 52/388, 405.1, 406.1, 406.2, 406.3, 419, 410, 424, 426, 570, 351–354, 358, 378, 357, 363

[56] References Cited

U.S. PATENT DOCUMENTS

| | | | |
|---|---|---|---|
| 4,223,501 | 9/1980 | DeLozier | 52/309 |
| 4,349,398 | 9/1982 | Kearns et al. | 156/71 |
| 4,489,530 | 12/1984 | Chang | 52/741 |
| 4,698,947 | 10/1987 | McKay | 52/309.12 |
| 4,860,515 | 8/1989 | Browning, Jr. | 52/426 |
| 4,889,310 | 12/1989 | Boeshart | 240/41 |
| 4,924,641 | 5/1990 | Gibbar, Jr. | 52/204 |
| 4,936,540 | 6/1990 | Boeshart | 249/216 |
| 4,967,528 | 11/1990 | Doran | 52/426 X |
| 5,065,561 | 11/1991 | Mason | 52/309.12 |
| 5,107,648 | 4/1992 | Roby | 52/309.12 |
| 5,140,794 | 8/1992 | Miller | 52/426 |
| 5,337,530 | 8/1994 | Beames | 52/426 |
| 5,390,459 | 2/1995 | Mensen | 52/426 |
| 5,428,933 | 7/1995 | Philippe | 52/426 X |
| 5,459,970 | 10/1995 | Kim | 52/424 |

*Primary Examiner*—Carl D. Friedman
*Assistant Examiner*—Yvonne Horton-Richardson
*Attorney, Agent, or Firm*—Loeb & Loeb LLP

[57] ABSTRACT

A wall form structure comprises modular components, wherein individual components are fitted together to construct residential or commercial wall structures. The wall form structure has prefabricated inner and outer walls, a connecting member which is positioned between the walls, and column members to hold the walls against the connecting member. The column member is equipped with perpendicular connectors which are inserted into openings of the prefabricated walls. The connectors are sufficiently longer than the thickness of the wall and engage onto the connecting member. The connecting member includes a mesh area to restrict the flow of concrete poured into cavities defined by two walls and a plurality of connecting members. Concrete may be poured into all or selective cavities depending on the use and purpose of the wall structure. The prefabricated wall may comprise a base wall, a mesh, a screen, a brace, an insulation, or any combination thereof. The wall form structure may be used as outer walls for a structure or used as inner partition walls.

28 Claims, 11 Drawing Sheets

Fig. 4
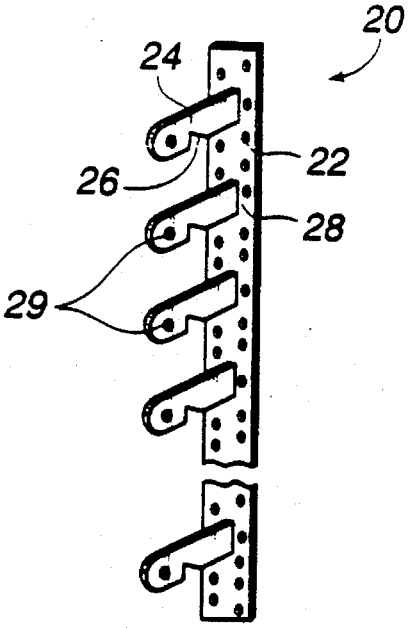
Fig. 5
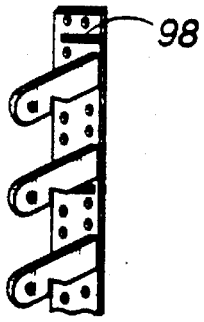
Fig. 6
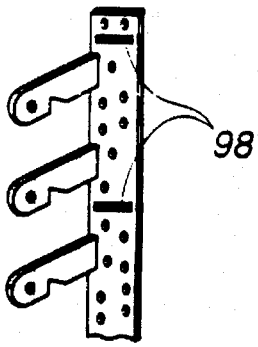
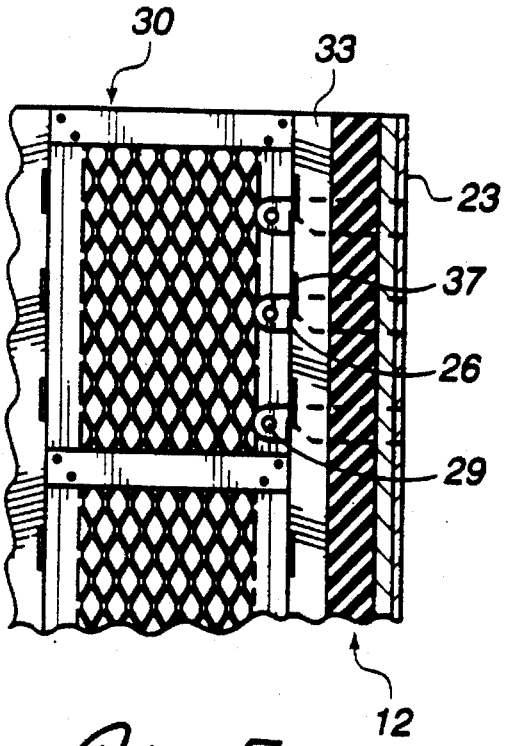
Fig. 7
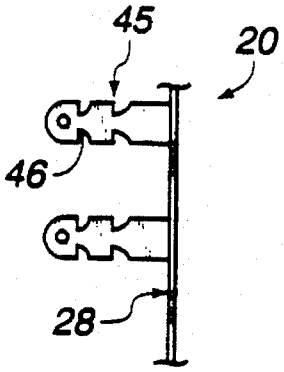
Fig. 8

Fig. 17
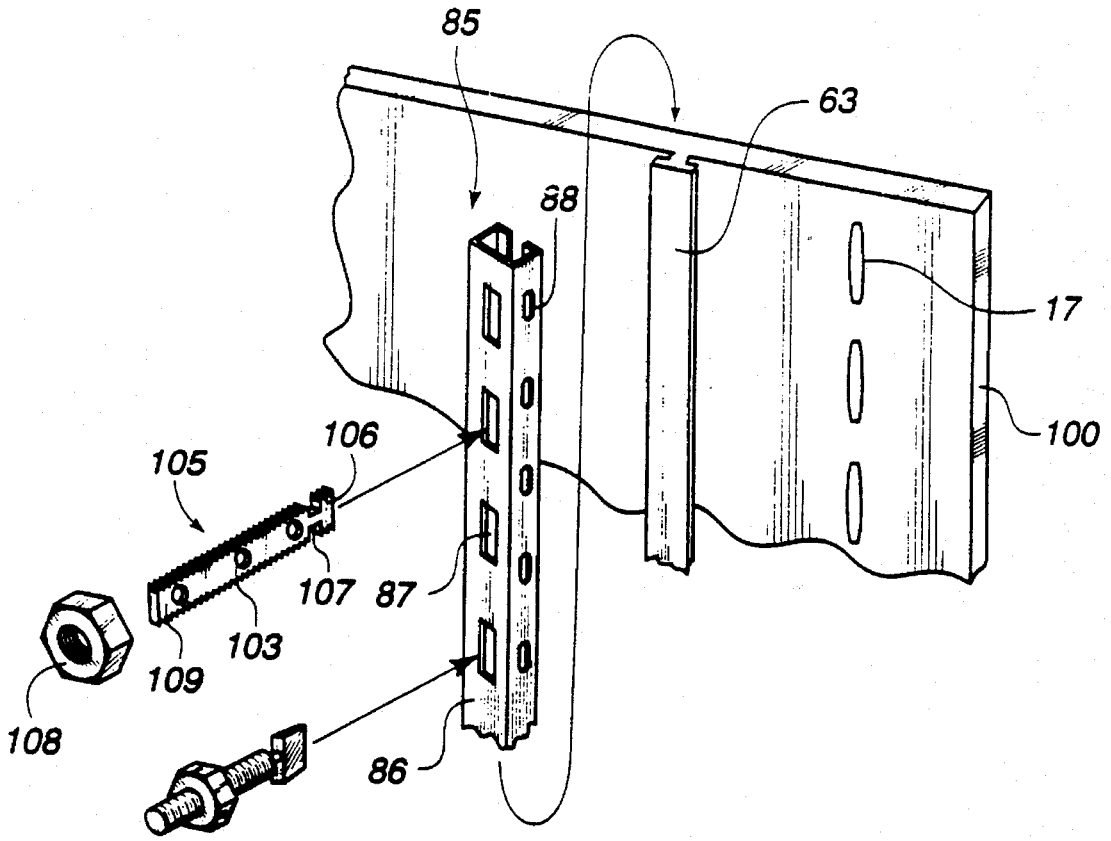
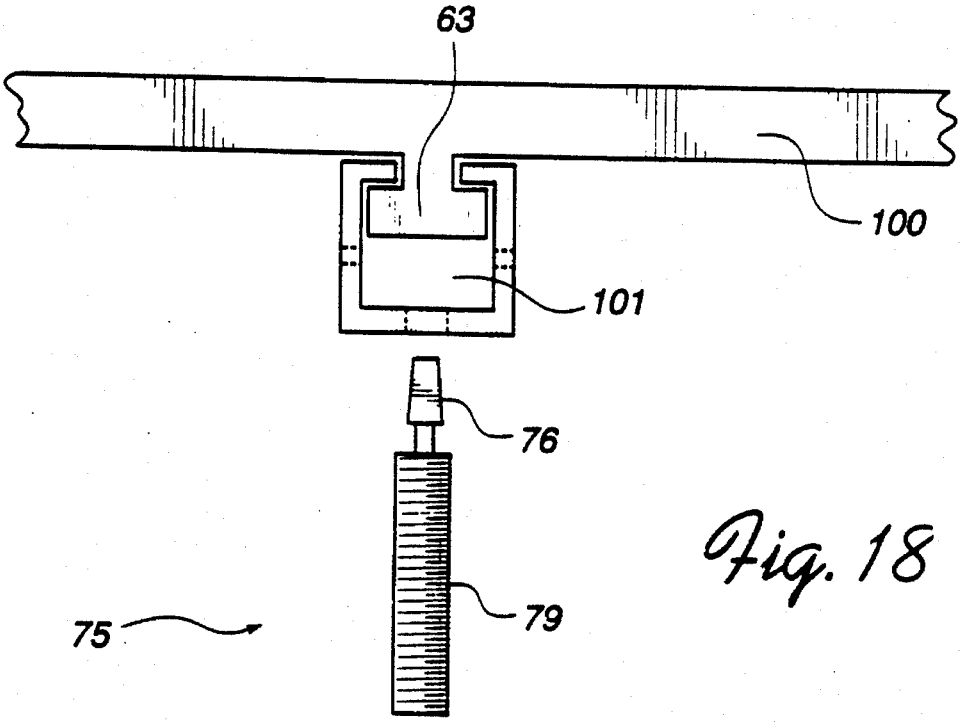
Fig. 18

WALL FORM STRUCTURE AND METHODS FOR THEIR MANUFACTURE

BACKGROUND OF THE INVENTION

1. FIELD OF THE INVENTION

This invention relates to a wall form structure and methods for their manufacture.

2. RELATED ART

There are many different ways to fabricate wall structures using such items as bricks, concrete blocks, or wooden frame construction. For example, cement blocks with hollow passages are often used to build walls. For many commercial applications, once the blocks are built up to a certain height, such as four feet, concrete is poured into the hollow passages in the blocks to strengthen the wall. Another four foot section is built on top of the first section, and so forth until the wall is completed. Reinforcing steel bars are usually placed within the open passages to reinforce the structure. Depending on the strength requirements for the wall, the poured concrete and steel rod reinforcement may not be needed. For example, the strength requirements for building a private house are generally less than those for commercial structures.

Constructing a wall from cement blocks as described above has several disadvantages. The process is time consuming because the many blocks used are each placed in proper alignment with those around it. In addition, it may be difficult to place wiring, plumbing, or insulation within the wall itself due to the structure of the blocks, which does not allow for easy access between the inner wall surface and the outer wall surface. Furthermore, the concrete region in a block wall may not be continuous, because it may be limited to the hollow passages within each block and the concrete regions in each passage may not contact the other concrete regions. The strengthening effect of the concrete is not as great as if one continuous concrete region existed within the wall.

A typical non-commercial structure wall may include a wooden frame, together with an inner wall surface of drywall board and an outer wall surface such as stucco. To build this type of wall, wooden studs such as 2"×4"×8" studs are placed every 16" or so along the desired wall area. To construct the outer wall surface, paper or wire mesh is tacked to the wooden studs and an outer wall surface material such as stucco is placed onto the paper or wire mesh. Drywall boards attached to the inside portion of the wooden beams form the inner wall surface.

This type of wooden frame wall has the advantage of allowing for relatively easy access to the region between the inner and outer wall surfaces for wiring, plumbing and insulation purposes. This type of wall construction has disadvantages. One major drawback is the time and labor necessary to fabricate the wall. Each wooden beam must be nailed into place, then the paper or wire mesh tacked on, the outer surface stucco applied, and the inner surface drywall attached to the studs. In addition, such a wall is not particularly strong, and cannot easily be reinforced with poured concrete and reinforcing rods.

One form of building wall using form construction is illustrated in U.S. Pat. No. 4,924,641 of Gibbar, Jr. Gibbar describes a composite wall fabricated of a combination of polymer forms which provide a latticework of voids into which concrete can be poured, providing a monolithic wall structure. One disadvantage of this structure is that wall boards, such as drywall or plywood, have to be secured to the finished composite wall structure to provide a finished interior or exterior wall. In addition, large interconnected voids are always formed between the walls, always requiring a large amount of concrete to be poured into the wall cavity.

U.S. Pat. No. 4,698,947 to McKay shows a wall structure including two foamed plastic sheets interconnected using a tie system. One disadvantage of this structure is a lack of compartmentalized cavities for containing the poured concrete. The McKay structure requires concrete to be poured within the whole wall structure to obtain any rigidity. Such construction techniques may require unnecessary amounts of concrete and may be less adaptable to different wiring, plumbing and insulation configurations.

SUMMARY OF THE DISCLOSURE

A wall form structure according to an embodiment of the present invention comprises a first prefabricated wall having a plurality of openings, a second prefabricated wall having a plurality of openings, a first column member coupled to the first prefabricated wall, a second column member coupled to the second prefabricated wall, and a connecting member, which is positioned between the first and second prefabricated wall and connects the same, thus forming a wall structure.

The first and second column members each comprise a planar stem member and a plurality of connectors. The planar stem member extends along a height of the respective prefabricated wall. The connectors secures to and extends substantially perpendicular from the planar stem member. The connectors are sized and arranged to fit the corresponding openings in the prefabricated walls and are sufficiently long to protrude through the prefabricated wall.

The connecting member has a first receiving member, a second receiving member and a coupling member. The second receiving member is coupled to the first receiving member by the coupling member. The first receiving member is secured to the first prefabricated wall by engaging the connectors of the first column member through the openings of the first prefabricated wall. The second receiving member is secured to the second prefabricated wall by engaging the connectors of the second column member through the openings of the second prefabricated wall.

The first prefabricated wall may comprise a screen and a base member, wherein the screen is secured to the base member and is configured to extend along a height and a width of the base member. Alternatively, the first prefabricate wall may be a metal mesh with a support member which extends along the height of the base member.

In accordance with a further aspect of the present invention, the coupling member comprises a mesh or at least one cross piece or both. The mesh has openings which are sufficiently small to restrict the flow of concrete, but sufficiently large so that the flow of concrete is not completely restricted.

In accordance with another aspect of the present invention, a method of constructing a wall form structure comprises steps of forming a first prefabricated wall having a plurality of openings, and a second prefabricated wall having a plurality of openings. The next step includes forming a first and a second column member each comprising a planar stem member and a plurality of connectors. The planar stem member extends along a height of the respective prefabricated wall, and the connectors are secured to and extended substantially perpendicular from the planar stem member. The connectors are sized and arranged to fit the corresponding openings in the prefabricated walls and are sufficiently long to protrude through the prefabricated wall. Then the first column member is secured to the first prefabricated wall through the openings of the first prefabricated wall. The second column member is secured to the second prefabricated wall through the openings of the second prefabricated wall. A connecting member is formed which has a first receiving member, a second receiving member and a coupling member, wherein the second receiving member is coupled to the first receiving member by the coupling member. The first receiving member is secured to the first prefabricated wall by attaching the first receiving member to the first column member, and the second receiving member is secured to the second prefabricated wall by attaching the second receiving member to the second column member.

BRIEF DESCRIPTION OF THE DRAWINGS

FIG. 4 is a perspective view of a column member according to an embodiment of the invention FIG. 5 is a perspective view of a column member with connectors attached to the right edge.

FIG. 6 is a perspective view of a column member with connectors attached to the left edge.

FIG. 7 is a partial cross sectional view of a wall structure as shown in FIG. 2.

FIG. 8 is a cross section view of a column member according to an embodiment of the invention.

FIG. 17 is an exploded view of still another embodiment of the brace as used in a wall structure.

FIG. 18 is a top plan view of FIG. 17.

DETAILED DESCRIPTION OF THE PREFERRED EMBODIMENTS

This application fully incorporates by reference the application Ser. No. 08/147,396, filed on Nov. 5, 1993.

Preferred embodiments of the present invention provide a wall form structure using prefabricated inner and outer wall sheets and cross members extending between the wall sheets for holding them together. Vertical columns are provided to support each of the inner and outer wall sheets. Connectors extend from the vertical column members. By inserting connectors into matching openings in the prefabricated walls, and engaging the connectors into the cross members positioned between two walls, finished walls may be erected in a shorter time than by the conventional method of erecting walls. If preferred, concrete may be poured into the cavities formed between the inner and outer walls for additional strength and support. Because of the ease of assembly, the prefabricated wall structure reduces construction time and saves money.

Figure 1:
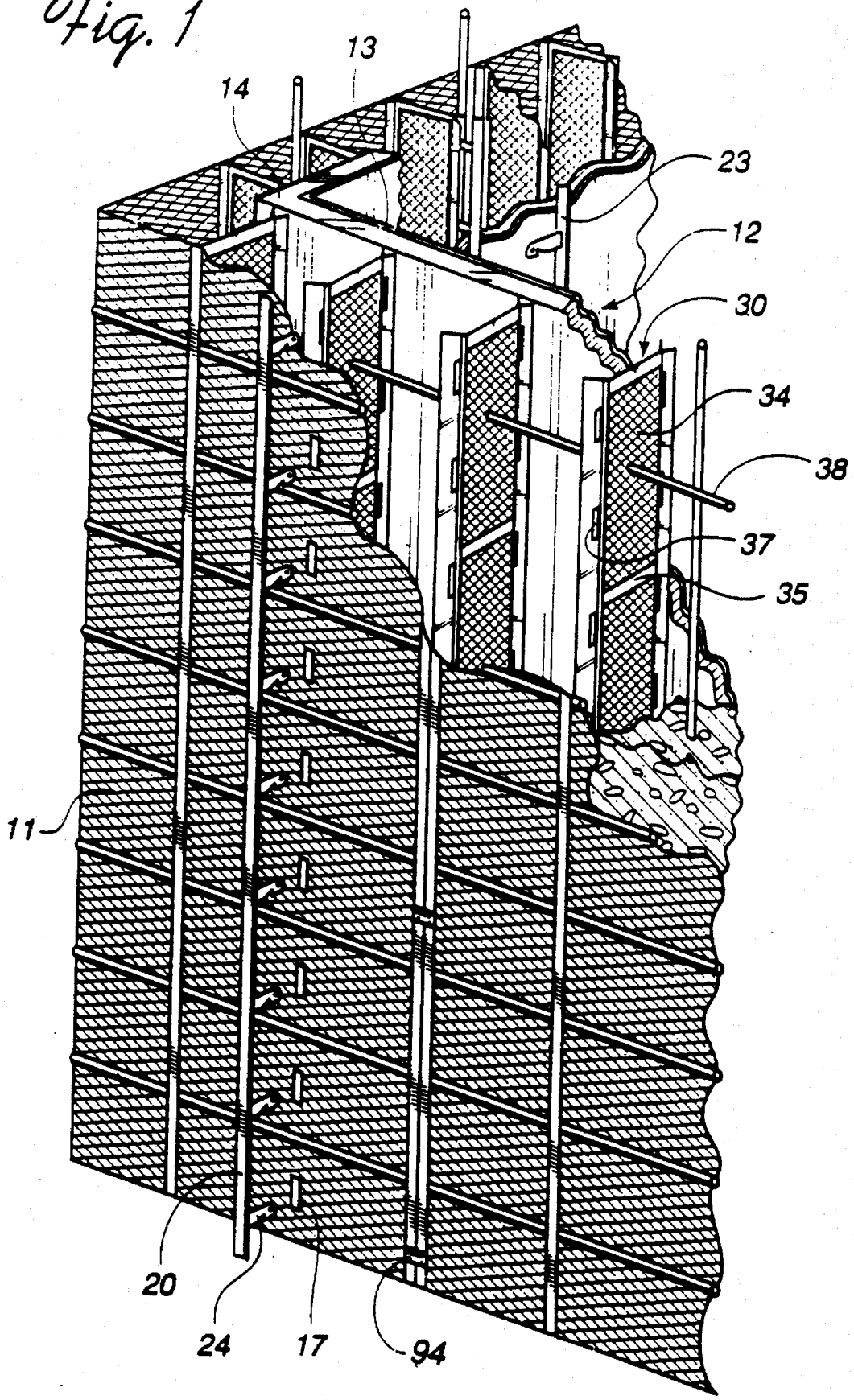
FIG. 1 is a perspective view of a section of a wall with concrete and reinforcing bars.

FIG. 1 shows a wall form structure according to one embodiment of the invention. The structure is composed of first 11 and second 12 prefabricated walls and at least one connecting member 30 secured to the first and second prefabricated walls. Contractors may choose different types of prefabricated wall materials in accordance with the particular use and purpose of the building. The prefabricated walls are used to fabricate a section of wall reinforced with concrete and strengthening bars, if necessary. "Prefabricate" here means that the wall members 11 and 12 are fabricated prior to being positioned in the structure. A plurality of wall sections can be used to build a variety of walled structures of varying heights.

Figure 2:
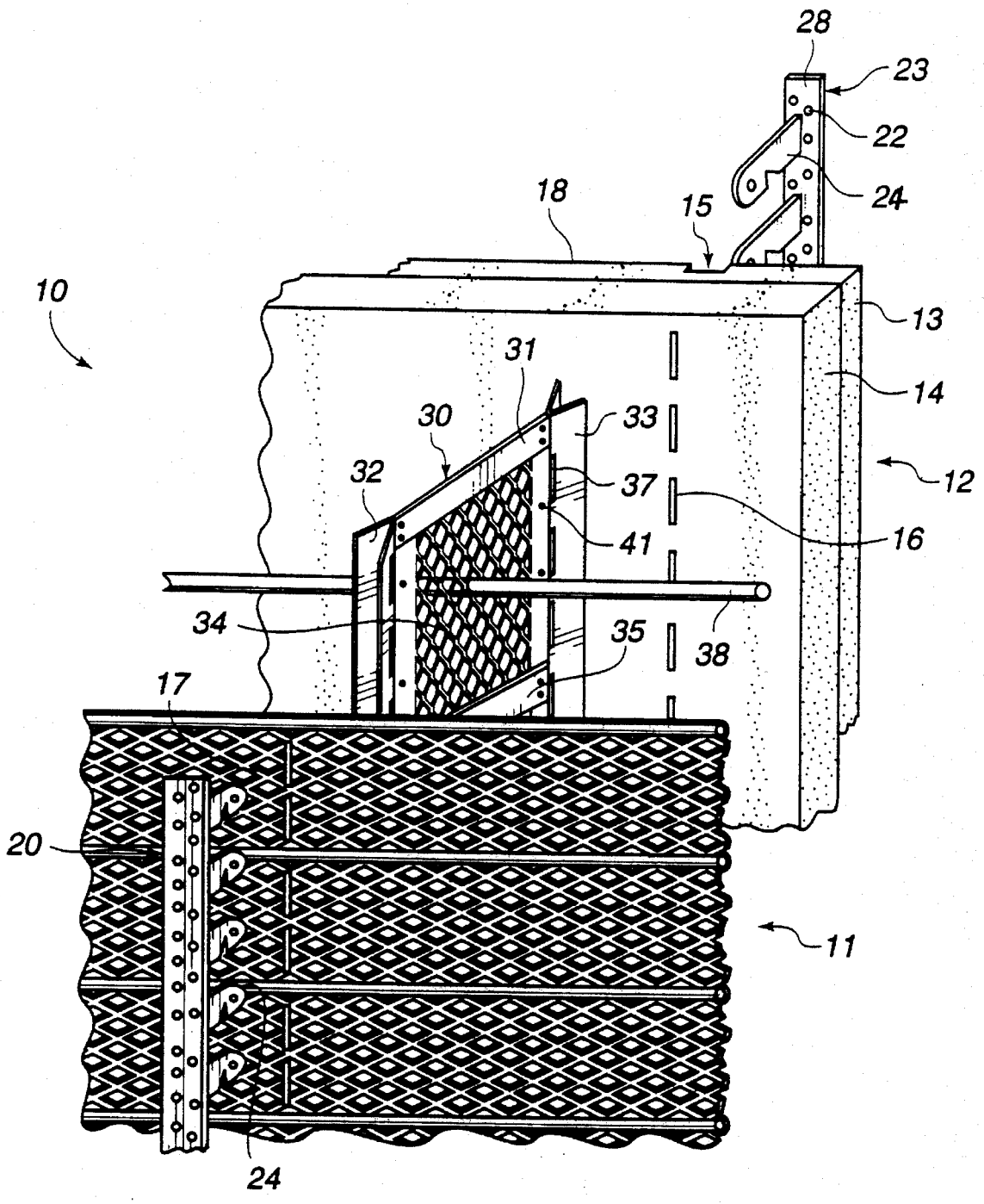
FIG. 2 is a perspective view showing an embodiment of first and second walls including a connecting member.

FIG. 2 shows a wall form structure, according to an embodiment of the invention, that comprises a first column member 20 with connectors 24, a second column member 23 with connectors 21, a first prefabricated wall 11 with regularly spaced openings 17, a second prefabricated wall 12 with regularly spaced openings 16, and a connecting member 30. The first prefabricated wall 11, which is typically used as an outer wall, can be made with any suitable materials, such as metal mesh, concrete, slate, or fiberglass. The first wall 11 contains a plurality of vertical openings 17 spaced in regular intervals, wherein the openings 17 are sized to fit the connectors 24 of the first column member 23. Each connector 24 preferably has a corresponding opening 17 in the first wall 11. It is preferred that the spacing between the openings 17 be substantially the same as the spacing between the connectors 24 so that the connectors 24 can easily slide into the openings 17. It is also possible to have connectors 24 for a plurality of, but not all, openings in the first wall 11. Upon assembling a number of first walls 11 with column members 20, the outer surface of the first walls 11 may be sprayed with stucco or other suitable coating material to give the finished appearance.

The second prefabricated wall 12, which is typically used as an inner wall, is generally composed of an insulating member 14 and a partition member 13. Insulating member 14 is abutted against and rigidly secured to the partition member 13 by any suitable process, preferably by bonding them with adhesives. Similar to the first wall 11, the second wall 12 contains a plurality of openings 16 spaced in regular intervals, wherein the openings 16 are sized and shaped to fit the corresponding connectors 21 of the second column member 23. Each connector 21 corresponds to an opening 16 in the second wall 12. It is preferred that the space between the openings 16 be substantially the same as the space between the connectors 21 so that the connectors 21 can easily slide into the openings 16.

It is preferable that the second wall 12 has column recesses 15 on the outer surface 18 of the partition member 13. The shape and dimension of the column recess 15 are preferably substantially the same as that of the second column member 23. The purpose of the column recess 15 is to snugly fit the second column member 23 into the second wall 12 without any part of the second column member 20 protruding from the outer surface 18 of the partition member 13. If desired, the assembled structure can then be covered by a joint compound material, such as plaster, or other covering material to obtain a smooth wall surface.

The insulating member 14 may also be used as part of the first wall 11 by abutting the insulating member 14 against the first wall 11. Such construction is especially preferred when the first wall 11 is made of a flexible material, such as a metal mesh, since concrete poured into a cavity formed by two walls might bulge the bottom of the metal mesh wall due to the pressure exerted at the bottom of the freshly poured wall. This option becomes more necessary as the poured portion of the concrete wall gets taller. Placing the insulating member 14 against the metal mesh wall will limit this type of deformation. The insulating member 14 of the second wall 12 is made of any suitable insulation material, such as polystyrene or foam urethane, which can withstand the concrete moisture and the lateral pressure of concrete poured into a cavity defined by two walls and two connecting members. The partition member 13 may be a drywall board or other suitable materials.

Figure 3:
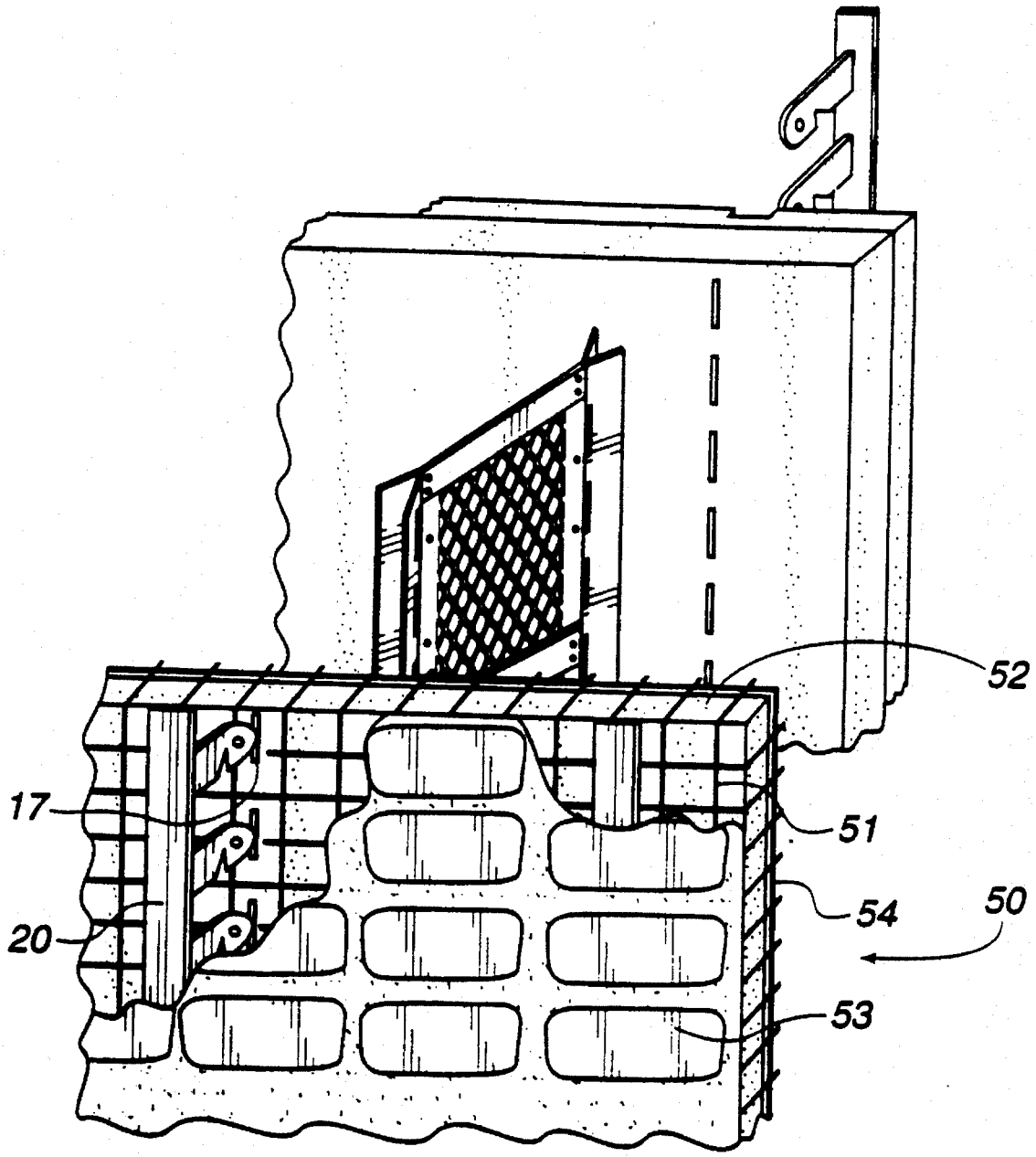
FIG. 3 is a perspective view showing another embodiment of first and second walls including a connecting member.
Figure 10:
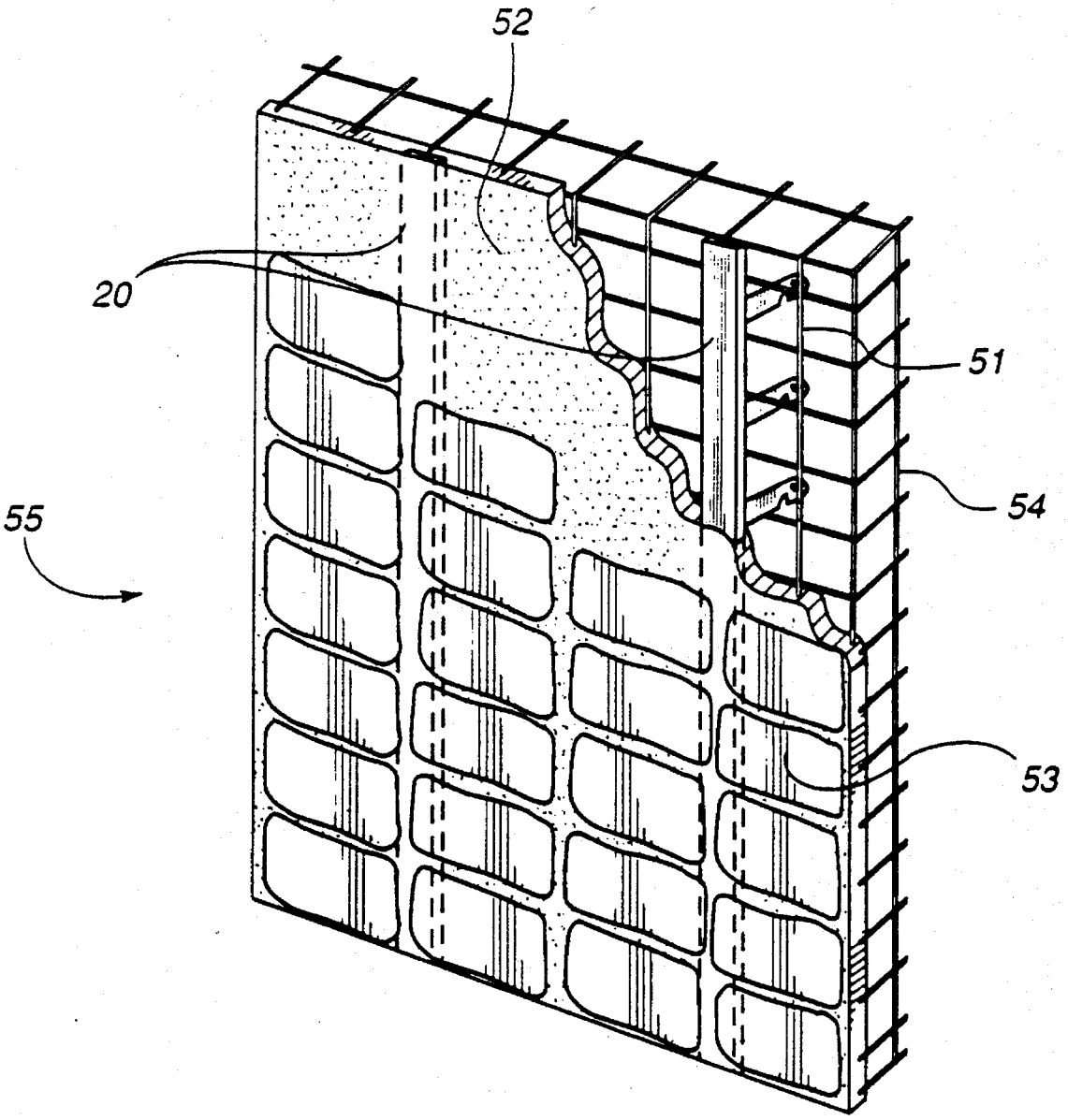
FIG. 10 is a perspective view of a prefabricated wall according to an embodiment of the invention.

Preferred embodiments of the invention include an alternate embodiment of a first prefabricated wall 50, as shown in FIGS. 3 and 10. In FIG. 3, the first wall 50 is composed of a base member 52 with a plurality of prefabricated openings 17, a screen 51 and at least one column member 20 inserted through the openings 17. The screen 51 is secured to the base member 52 and is configured to extend along the height and width of the base member 52. The first wall 50 is then coated with any suitable coating material 53, such as cement or stucco, to join the elements together. The base member 52 of the wall 50 may be made of any suitable material, such as slate, fiberglass, concrete, or plastic.

A difference between the embodiments illustrated in FIGS. 3 and 10 is the placement of the screen 51. FIG. 10 shows the screen 51 embedded within the base member 52 for strengthening the wall. A first prefabricated wall 55 may be manufactured by placing the screen 51 into a substantially rectangular mold, preferably 4 feet by 8 feet in dimension, which may include a mold for a plurality of openings 17. Then, the column members 20 are placed on top of the screen 51 at which time concrete or other suitable material is poured into the mold. After the concrete hardens, the first wall 55 may be coated with a coating material 53, such as cement, tiles, or stucco. As shown in FIGS. 3 and 10, it is preferable that the boundaries 54 of the screen 51 be bent toward the concrete filled region. When the boundaries 54 are embedded into concrete, it becomes an integral part of the concrete, and the first wall 50 is further strengthened.

The first 11 and second 12 prefabricated walls may be made to any size desired, such as four feet in width by eight feet in height by one inch thick. The size of the wall, to some extent, depends on the particular structure being built and the strength requirements. In some circumstances, it may be desirable to make the second wall body smaller than the first wall body, for example, making the first wall four feet wide by eight feet high and making the second wall four feet wide by four feet high in dimension. Thus, two second wall members are used for each first wall piece, which allows the interior region to be built up four feet at a time. This enables building inspectors to easily inspect the structure at four foot intervals, as required in certain building codes.

As shown in FIGS. 4, 5 and 6, column member 20 may comprise a planar stem member 28 and a plurality of connectors 24, wherein the connectors 24 are secured to and extend substantially perpendicular from one surface of the planar stem member 28. The connectors 24 may be secured to the column member 20 using any suitable method. For example, if the column member 20 and connectors 24 are made of sheet metal, then welding is suitable to secure them. Alternatively, molding or stamping may be proper, particularly if the column member 20 and connectors 24 are made of polymer.

Column members 20 preferably secure the prefabricated walls to the connecting members 30 without the use of nails, screws or adhesives. Connectors 24 engage the corresponding receptacles 37 in the first receiving member 32 through the openings 17 of the prefabricated wall 11. The length of the first column member 20 may be of any suitable size to fit the height of the first wall 11, with a typical height of eight feet. In addition, it is preferable to include one or more small holes 22 in the planar stem member 28 to enhance the adhesion of joint compounds, such as plaster or stucco, to its surface. The above detailed description about the first column member 20 may also apply to the second column member 23, because the two column members have identical features in preferred embodiments.

Figure 9:
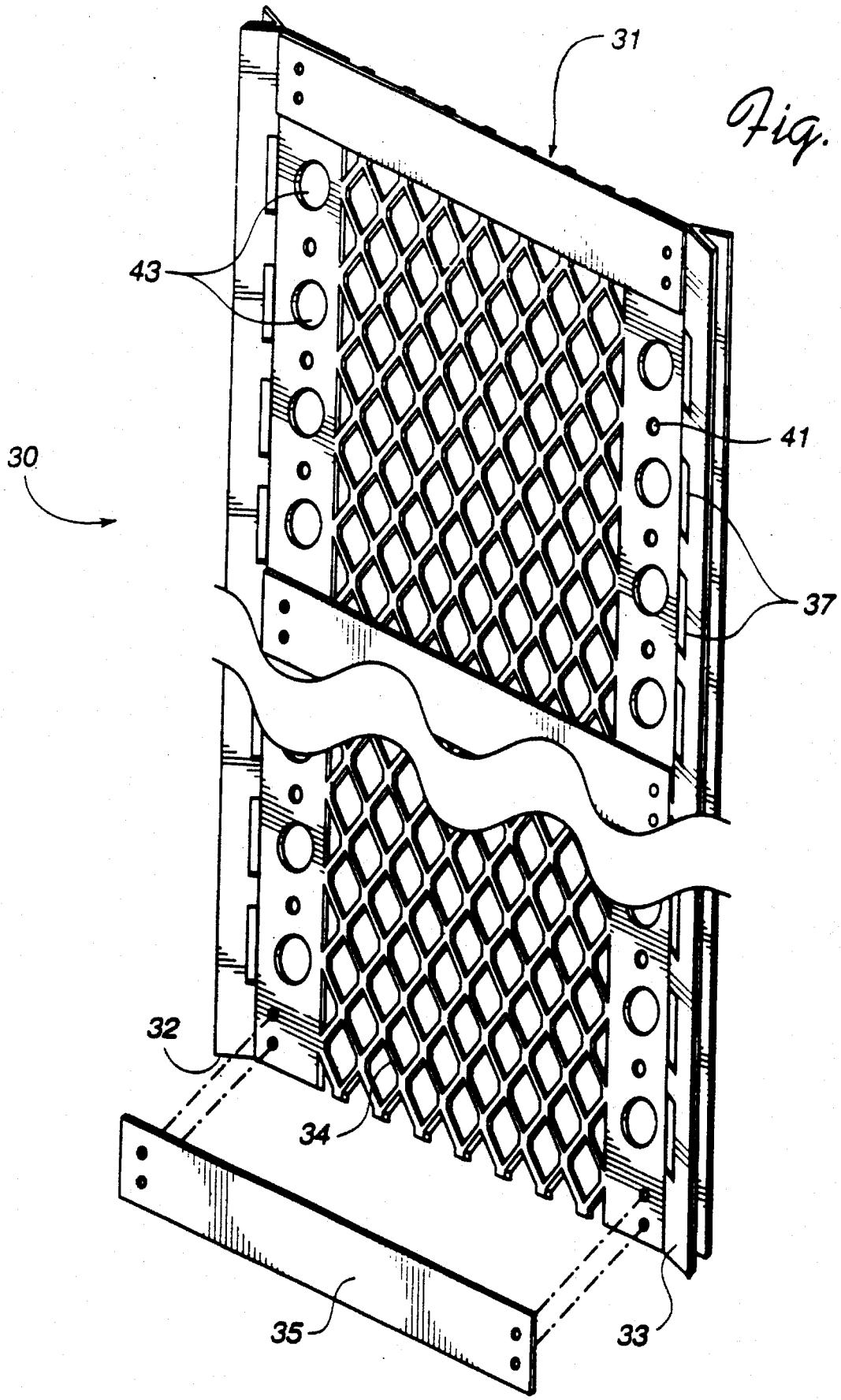
FIG. 9 is a perspective view of a connecting member according to an embodiment of the invention.

As shown in FIGS. 4, 7 and 9, the connector 24 comprises an aperture 29 and an indentation 26. The connector 24 is inserted into the corresponding receptacle 37 in the receiving member 33 through the corresponding opening in the prefabricated wall. Once the connector 24 engages the connecting member 30, the aperture 29 is aligned with an alignment opening 41, wherein a fastener, such as a screw, may be used to secure the connector 24 to the connecting member 30. As shown in FIGS. 5 and 6, the connectors 24 may protrude from the edges of the planar stem member 28, rather than from the center. These types of column members 20 may preferably have a plurality of horizontal incisions 98 for receiving a fastening member 95, such as the one shown in FIG. 11. The use of these column members 20 with the fastening member 95 is described below.

FIG. 7 shows a cross sectional view of the second column member 23 connected to the connecting member 30. The length of connector 24 may be of any suitable size sufficient to penetrate the thickness of the wall 12 and engage the receptacle 37. In a preferred embodiment, once the connector 24 enters the corresponding receptacle 37 in the second receiving member 33, the indentation 26 engages the bottom portion of the receptacle 37, thus locking the second prefabricated wall 12 to the connecting member 30. The same procedures may be repeated for the first prefabricated wall 11.

Another embodiment of a connector 45 is shown in FIG. 8. This embodiment shows a connector 45 having a plurality of indentations 46 both on the top and the bottom. This feature eliminates the formation of gaps between the wall and connecting member 30 when the distance between the indentation 46 and the planar stem member 28 is larger than the thickness of the wall. Instead of making column members 20 with different length connectors 45 for walls with varying thicknesses, only one size connector may be made with a plurality of indentations 46. This aspect of the invention may significantly save manufacturing costs and shorten construction time, since construction personnel need not waste time looking for column members with different size connectors. The indentations 46 on both sides of the connector 45 allows prefabricated walls with embedded column members 23 to be used upside down. Other types of connectors, including but not limited to different shaped hooks, clips, bolts, or even welding, could be used, though a non-permanent connection is usually preferred to allow for disassembly if the need arises.

As shown in FIG. 9, in preferred embodiments, the connecting member 30, which is positioned between the first 11 and second 12 prefabricated walls, is composed of a first receiving member 32 coupled to a second receiving member 33 by a coupling member 31. The first 32 and second 33 receiving members have regularly spaced receptacles 37 to form an interlocking joint with the connectors 24 and 21. Receiving members 32 and 33 of the connecting member 30 may be bent so as to form a substantially V-shaped crevice, the V-shaped crevice having receptacles 37 incorporated into it. The receptacles 37 are shaped so as to accept the corresponding connectors 21 of the first 20 or second 23 column member. Holes 43 may be placed in the connecting member 30 to allow concrete to flow into adjoining sections, if desired.

FIG. 9 shows an embodiment of the present invention where the connecting member 30 includes mesh 34 and cross pieces 35. This embodiment allows for the use of either the cross piece 35 or the mesh 34, or both together. For example, if adjoining sections are to be filled with concrete, cross pieces 35 may be used because there is no need to restrict the flow of concrete between adjoining sections. In addition, it sometimes is desirable to use the cross pieces 35 with the mesh 34 to create a more rigid structure. Alternatively, the mesh 34 assembly may be used without the cross pieces 35 when concrete is poured into only certain selective compartments.

As shown in FIG. 1, certain embodiments of the present invention include a plurality of connecting members 30. Concrete may be poured between the first 11 and second 12 walls to strengthen the entire wall structure. Alternatively, concrete may be selectively poured into certain compartments defined by connecting members 30. The mesh 34 area of the connecting member 30 is constructed to restrict the flow of concrete. However, the flow of concrete will not be completely restricted. The mesh 34 may be constructed so that if concrete is poured on both sides of the mesh 34, there will be enough contact between the concrete on both sides of the mesh 34 to create a continuous concrete structure which enhances the mechanical properties of the wall.

Another preferred embodiment of the connecting member 30 includes a unitary structure, rather than the three piece assembly discussed above. For example, a piece of sheet metal may be cut and bent into the structure illustrated in FIG. 9. As described above, the V-shaped crevices may be easily constructed, with prefabricated receptacles 37, by bending the sheet metal. The coupling member 31 in the form of metal mesh could be constructed by making small vertical incisions and pulling both ends of the connecting member. The pulling force will cause the incisions to become small openings. The connecting member 30 may also be formed by molding or stamping any suitable material with sufficient resiliency, such as fiberglass or plastic, to withstand the pressure exerted by concrete.

Figure 11:
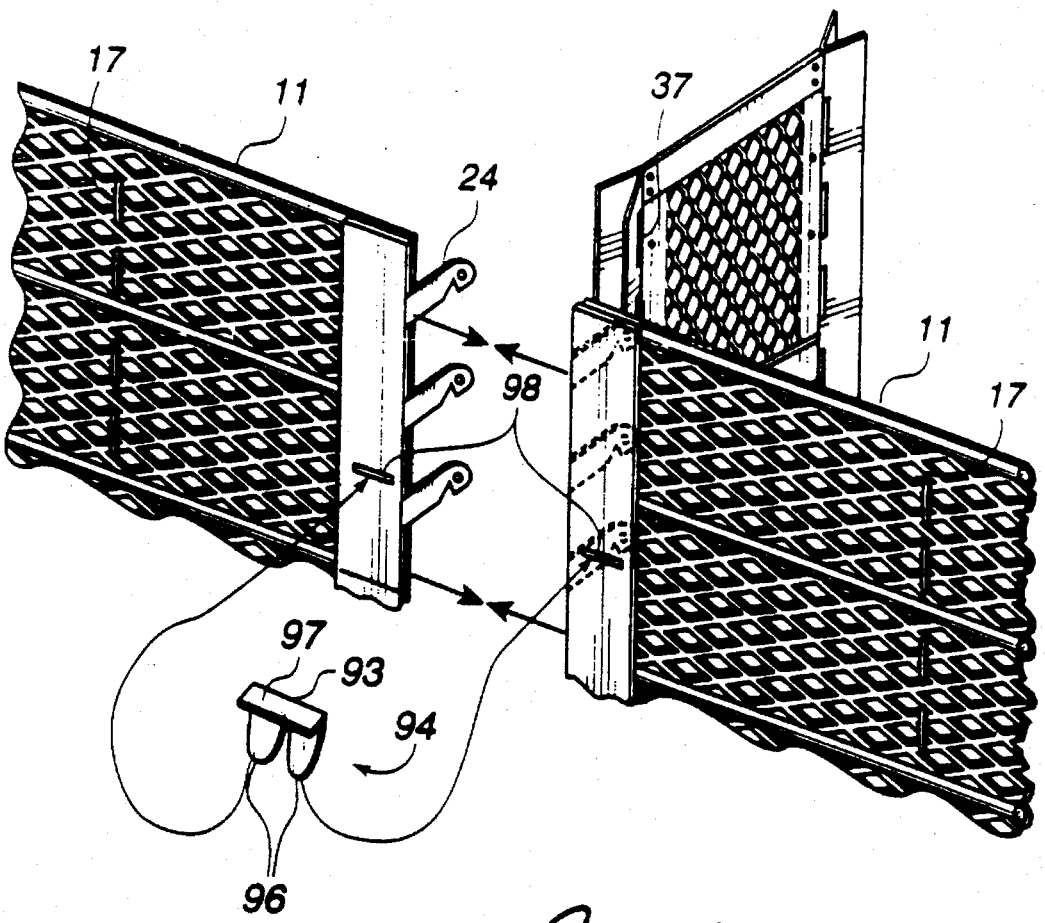
FIG. 11 is a perspective view of one embodiment of a fastening member.

FIG. 11 shows how two prefabricated walls 11, preferably made of metal mesh, are joined together according to certain embodiments of the present invention. When two metal mesh walls are placed adjacent to each other, the connectors 24 of two separate column members shown in FIGS. 5 and 6, which are connected to the respective metal mesh, will abut each other, thus allowing them to be inserted into the corresponding receptacles 37 of the connecting member 30. Slits 98 are used for mounting a fastening member 94.

The fastening member 94 includes feet 96 suitably shaped to fasten two adjacent walls and a wing 97 which is attached substantially perpendicular to the feet 96, thus forming a substantially L-shaped member. The fastening member 94 clamps the walls together when both feet 96 of the fastening member 94 are inserted into the respective slits 98. In a preferred embodiment, as both feet 96 are inserted into the slits 98, the feet 96 pull the column members together to the merging point 93 of the feet 96, which in turn pulls the attached walls together. The wing 97, which protrudes from the outer wall, is embedded into and becomes integral part of the exterior coat of cement or other suitable coating material, such as stucco.

Figure 12:
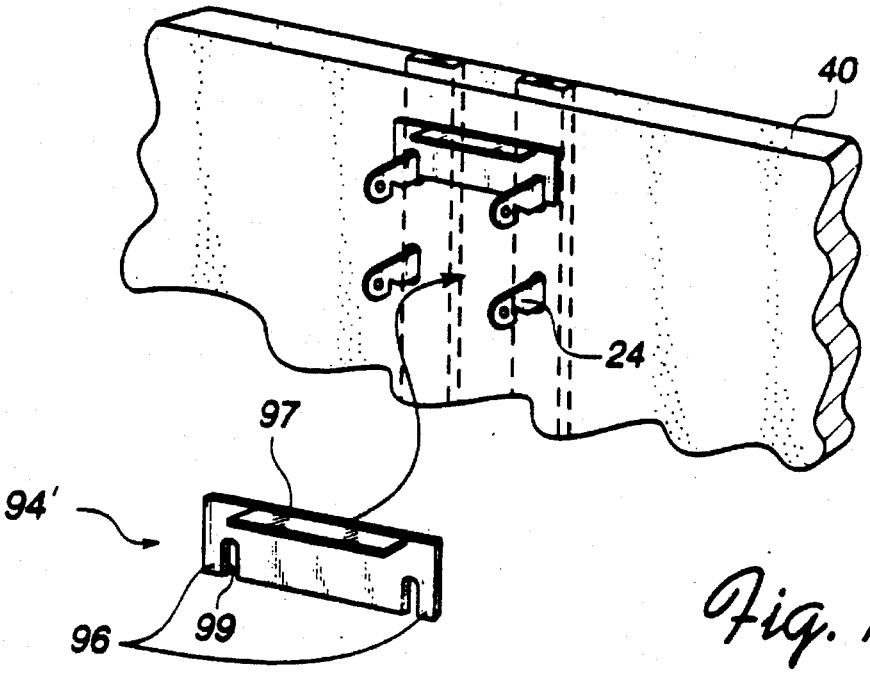
FIG. 12 is a perspective view of another embodiment of a fastening member.

Another embodiment of a fastening member is shown in FIG. 12. Where the fastening member 94 shown in FIG. 11 is used on the outer wall, the fastening member 95 shown in FIG. 12 is used on the inner wall by engaging the notches 99 onto connectors 24 protruding through the wall. When connecting members 30 are secured to connectors 24, the fastening member 95 is pressed between the connecting member 30 and the wall, thus creating a tight seal between two adjacent walls.

Figure 13:
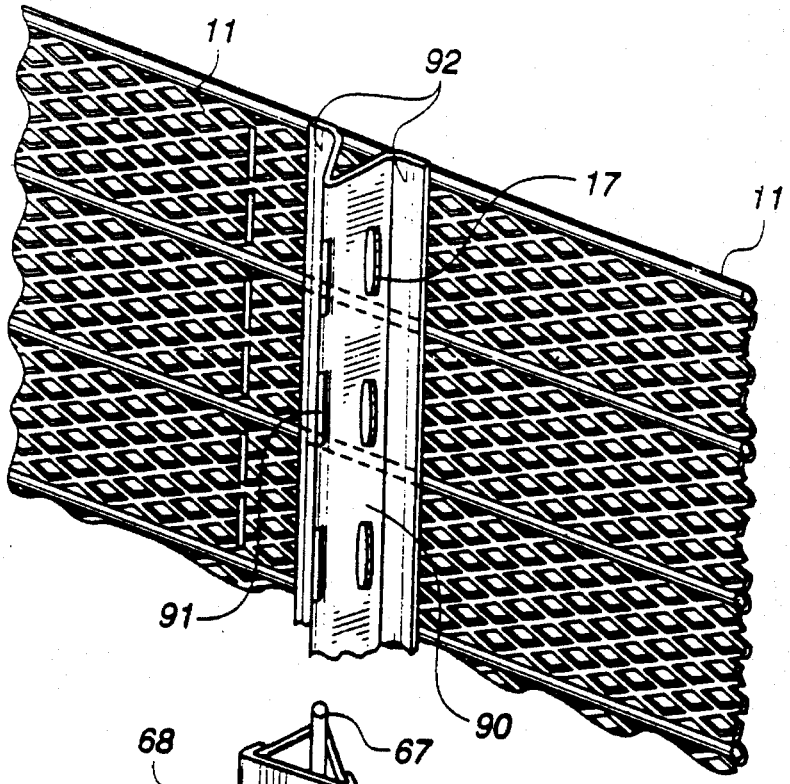
FIG. 13 is a perspective view of a support member according to an embodiment of the invention.

When a flexible material, such as a metal mesh, is used for the first prefabricated wall 11, at least one support member 90 may be necessary, as shown in FIG. 13, to provide some rigidity to the wall. This enhances the handling of the wall. In a preferred embodiment, the support member 90 may be bent so as to form a substantially V-shaped crevice, the V-shaped crevice having openings 91 incorporated into it. Because this shape is substantially similar to the receiving member 32, both members can have a snug fit. Preferably, the openings 91 are substantially aligned with the openings 17 of the prefabricated wall 11 so that connectors 24 are inserted therethrough and engage onto the receiving member 32. The support member 90 also has shoulders 92 which are connected to the metal mesh by suitable processes, such as spot welding.

Figure 14:
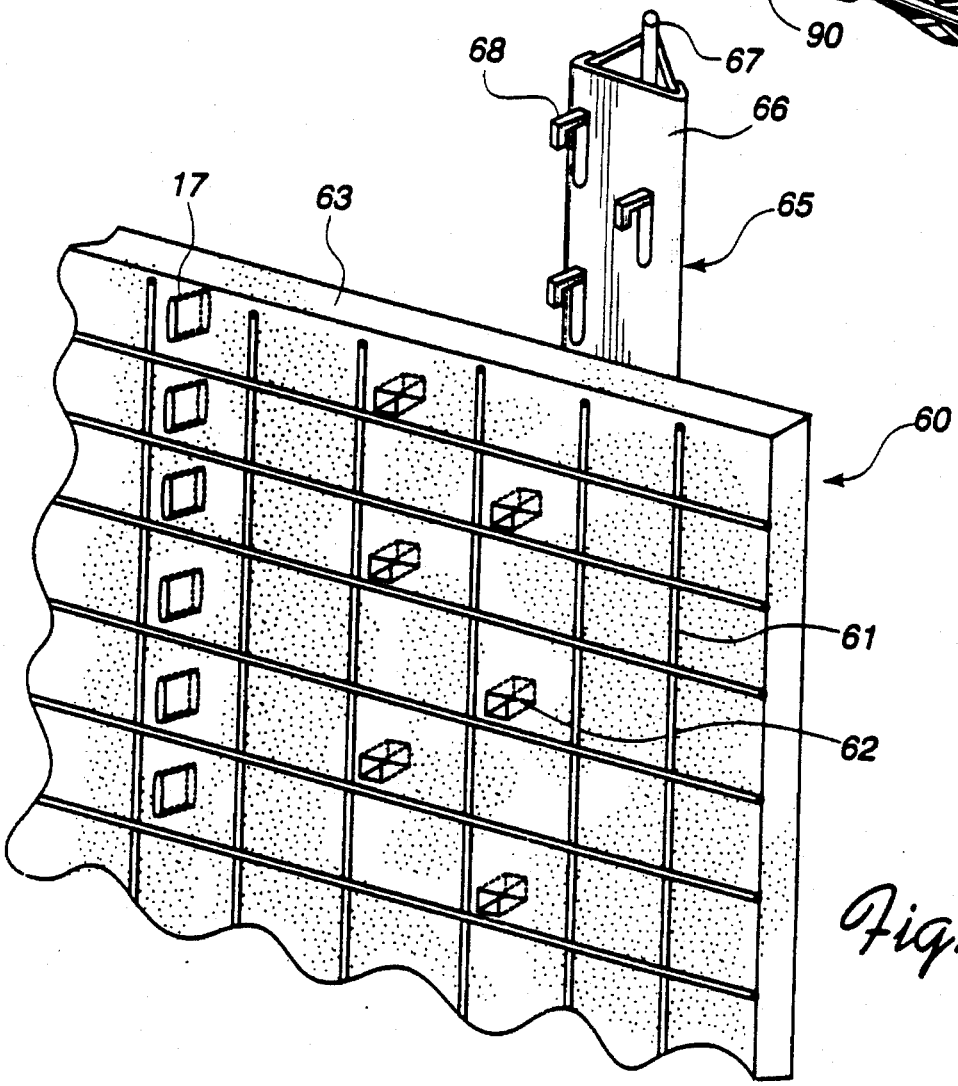
FIG. 14 is a perspective view of a prefabricated wall with a brace according to an embodiment of the invention.
Figure 15:
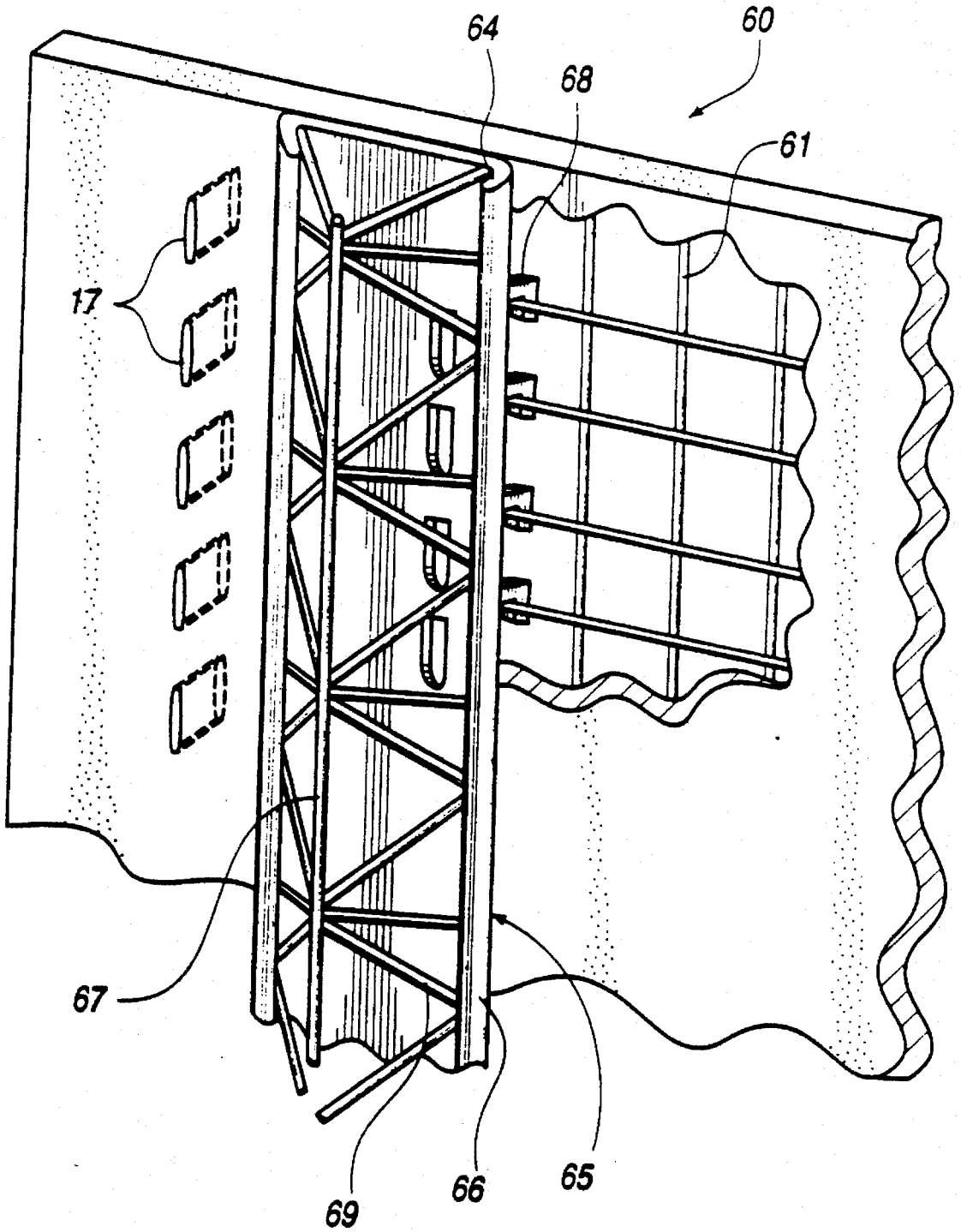
FIG. 15 is a perspective view of another embodiment of a prefabricated wall with a brace.

Preferred embodiments of the invention include a variation of a first prefabricated wall 60, as shown in FIGS. 14 and 15. This particular embodiment of the first wall 60 is composed of brace 65 which is positioned and secured vertically to first wall 60 to provide a longitudinal and horizonal support. The brace 65 has a base 66, a spine 67, and a plurality of hooks 68 protruding from the base 66. The base 66, preferably made with sheet metal or other suitable material, is curved along the edges to form lips 69 along the longitudinal length of the base 66. The spine 67 is composed of legs 69 which extend from the spine 67 in an inverted V-shape. The spine 67 is secured to the base 66, preferably either by spot welding the ends of the legs 69 to the inner surface of the lip 69 or by clamping the lip 69 and the ends of the legs 69 to the base 66. In a preferred embodiment, the legs 69 are diagonally crossed, extending from the spine 67 to the base 66, thus enabling the brace 65 to withstand vertical and horizonal force.

Embodiments of the present invention may be constructed in a number of ways, depending on the wall materials being used. As shown in FIG. 14, when a suitable base member, such as slate, fiberglass or pressed wood is used, a screen 61 is placed on one side of the base member 63 which has a plurality of holes 62 sufficiently large to accommodate the hooks 68. The brace 65 is secured against the other side of the wall material 63 by engaging the hooks 68 through the holes 62 and onto the screen 61. Then, a suitable coating material, such as stucco or cement, may be sprayed on top of the screen to form a prefabricated wall 60.

Another way to construct wall structures according to embodiments of the present invention is as follows. The brace 65, which has protruding hooks 68 pinched against the screen 61, is set within the mold (not shown). The mold preferably defines the openings 17 for receiving connectors 24 of column members 20. The hooks 68 will hold the screen 61 above the bottom surface of the mold. Next, a suitable wall material, such as concrete or polymer, is poured into the mold. When the suitable wall material hardens and the mold is removed, a wall is formed with the hooks 68 and screen 61 all embedded and hidden within the wall. In preferred embodiments, for each wall measuring four feet by eight feet in dimension, typically at least three braces may be used to provide sufficient support for the wall.

Because of their ability to withstand substantial weight and force, the walls shown in FIGS. 14 and 15 may be used as floor panels. A concrete floor in a multiple story building may be constructed by positioning these walls as to form a floor mold and to pour concrete thereon. Upon hardening of the concrete, the brace 65 is embedded within the concrete, thus making the embodiments shown in FIGS. 14 and 15 an integral part of the floor. If desired, reinforcing steel bars may be placed on the floor mold to strengthen the floor before concrete is poured. Due to the strength provided by the braces 65, the floor created by this embodiment may be used as a work space by laying wood panels on top of the braces 65, prior to the pouring of concrete thereon.

Figure 16:
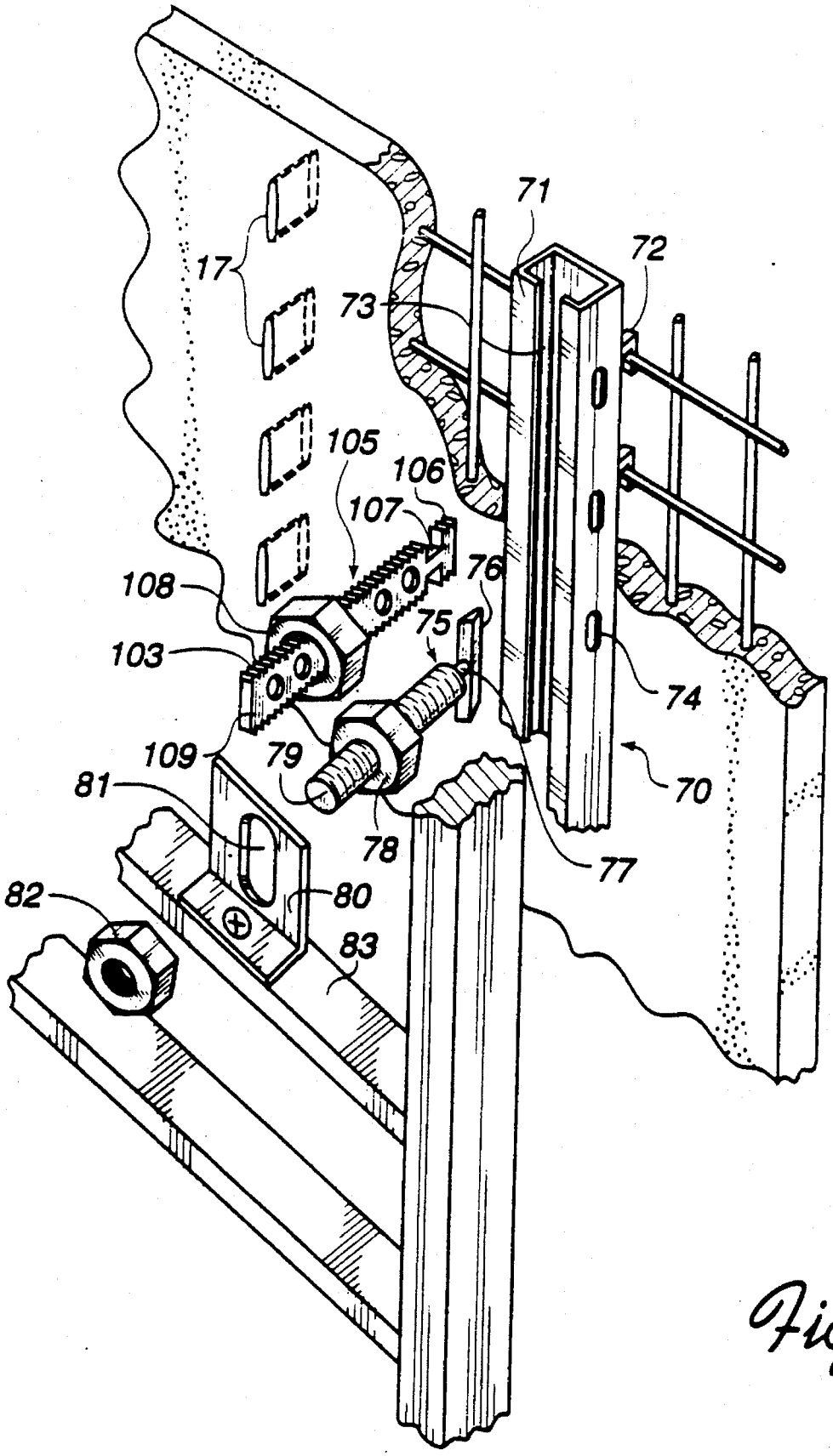
FIG. 16 is an exploded view of another embodiment of the brace as used in a wall structure.

Another embodiment of a brace is shown in FIG. 16. In the illustrated embodiment, a brace 70, preferably a hollow tube with a rectangular cross section, is composed of a front plate 71 having a vertical slits 73 and regularly spaced hooks 72 protruding from the side opposite to the front plate 71. The other two sides may have a plurality of holes 74 through which concrete or other suitable filling material may flow. When assembled, concrete is poured through the holes 74 to strengthen the wall.

Another embodiment of a brace 85 is shown in FIG. 17. The brace 85 preferably has a hollow tube with a rectangular cross section and comprises a front plate 86 having a regularly spaced vertical slits 87. In this particular embodiment, the brace 70 does not use the hooks 72 to engage onto the wall 100. Instead, the wall 100, preferably made with slate, fiberglass, drywall or pressed wood, is equipped with a plurality of tracks 63 on which the brace 85 could slide, as shown with an arrow in FIG. 17. The thickness of the track 63 may be smaller than the thickness of the brace 85 to define a space 101 between the track 63 and the front plate of the brace 85 for receiving a fastener 75.

As shown in FIG. 16, two types of fasteners 75 and 105 may be inserted into a slit 73. The fastener 75 is similar to a bolt and may have a first end 76, a second end 79, and a neck 77, wherein the first end 76 has a flat head 76 sized to fit the slit 73. Once inside the slit 73, the fastener 75 is turned approximately 90 degrees to engage the brace 70. A nut 78 is rotated onto the fastener 75 through the second end 79 and secured against the brace 70, thus firmly holding the fastener 75 perpendicular to the face of the brace 70.

Alternatively, the fastener 105 has a flat first end 106, a flat second end 109 coupled to the first end 106 with a neck 107, wherein the second end 109 has a plurality of holes 103. Unlike the other fastener 75 described above, the widths of the first 106 and second 109 ends of the fastener 105 are the same. This feature reduces the installation time of the fastener 105 into the front plate 71, since the nut 108 may be screwed into the fastener 105 from the shorter first end 106, instead of from the longer second end 109. The holes 103 in the second end 109 of the fastener 105 may be used for allowing concrete to flow through them, thus making the brace 70 or 85 an integral part of the wall structure. This enhances the strength of the wall.

The walls shown in FIGS. 16 and 17, need not be used in combination with connecting member 30 and column member 20 or 23. For structures that do not require inner walls, such as a warehouse or storage space, the illustrated walls may be installed as outer walls without the use of the connecting members 30 and column members 20. Instead, to provide support, the fastener 75, with its first end 76 attached to the brace 70 or 85, may be secured to a mounting member 80, such as an L-shaped bracket, which is attached to a stud 83, wherein the second end 79 of the fastener 75 is inserted into an opening 81 of the mounting member 80 and is secured into place by a nut 82. Alternatively, if the second type of fastener 105 is used, the second end 109 may be placed on the stud 83 and a screw or other suitable fastening means may be inserted through the hole 103, thus securely attaching the fastener 105 to the stud 83.

One advantage of the embodiments shown in FIGS. 16 and 17 over commonly used sheet metal walls is the elimination of the use of nails or screws to secure the wall to a stud. This makes the outer walls more aesthetically pleasant. In addition, these embodiments prevent water from seeping into the structure, because there are no holes created by nails or screws. Preferably, when used without connecting members 30, the base member may be fabricated without the openings 17.

In other embodiments of the present invention, the connecting members 30, first prefabricated wall 11, first 32 and second 33 receiving member, first 20 and second 23 column members, connectors 21, joint member 90, fastening member 95 and cross piece 35 may preferably be constructed from galvanized steel, which provides protection from corrosion. Alternatively, materials including, but not limited to, other metals and polymers could be used. In addition, the first prefabricated wall 50 shown in FIG. 10 could also be constructed from materials other than concrete, including but not limited to, polymers. The choice of material for the various parts of the present invention generally depends on factors such as cost and strength.

Any number of reinforcing bars 38, typically made from steel, may easily be used in the present invention, if necessary. FIG. 2 shows a view of one means for holding a horizontal reinforcing bar 38 in place according to embodiments of the present invention. The horizontal reinforcing bar 38 could rest on the cross piece 35, or holes could be cut through the mesh 34 into which the reinforcing bar 38 could be placed. In addition, as described in application Ser. No. 08/147,396, filed on Nov. 5, 1993 by the same applicant, which is fully incorporated herein by reference, rollers (not shown) attached to the connecting members may be used for positioning reinforcing bars.

Inherent in the subject matter of this preferred embodiment are the methods and means by which the various wall forms are integrated together, in the formation of an overall wall structure. While the forms of the preferred embodiment of this invention may be of approximately four feet by eight feet in dimension, a building wall may be of substantially greater size. Hence, a plurality of these wall forms will need be interconnected together, to form the overall dimension for the building wall, and various ties are generally incorporated between the edges of vertically adjacent forms. Similarly, one large sheet of prefabricated wall structure may also be used to form the overall dimension for the building wall. In addition to walls built for houses, buildings and warehouses, the above embodiment of the invention may also be used to construct other structures, including sound barriers, retaining walls, or fences.

Walls built according to the present embodiments may be inexpensive and can be built quickly, because there are no blocks to lay, and no hammering of wooden studs every sixteen inches to create a frame. Little or no heavy equipment is needed, and large sheets may be easily maneuvered into place. Concrete with steel reinforcing bars may be used when necessary to increase the strength of the wall. If desired, poured concrete may be used in some regions of the wall, and not in others. The size of the concrete areas may vary as well, because any number of connecting members may be attached to the walls. In addition, easy access to the interior area within the wall is allowed prior to pouring in concrete, thus enabling insulation, plumbing, and wiring to be easily and inexpensively installed.

Another advantage of the preferred embodiment is the convenience in transporting the materials to construction sites. Because the fabricated walls are flat with no protruding members, they can be stacked and transported without jeopardizing their integrity. This feature reduces transportation cost and time, since more materials can be shipped together as a single load. Furthermore, the various embodiments of the first wall may be textured, painted, or coated so as to create any appearance desired, such as a tile or brick face appearance. As a result, the scope of the present invention extends to a variety of structures, materials, and methods of fabrication as disclosed above.

While the present invention has been described with reference to specific preferred embodiments thereof, it will be understood by those skilled in this art that various changes may be made without departing from the true spirit and scope of the invention. In addition, many modifications may be made to adapt the invention to a given situation without departing from its essential teachings.

What is claimed is:

1. A wall form structure comprising:

a first prefabricated wall having a plurality of openings;

a second prefabricated wall having a plurality of openings;

a first column member coupled to the first prefabricated wall;

a second column member coupled to the second prefabricated wall, the first and second column member each comprising a planar stem member and a plurality of connectors, the planar stem member extending along the respective prefabricated wall, the connectors secured to and extending substantially perpendicular from the planar stem member, wherein the connectors are sized and arranged to fit the corresponding openings in the respective first and second prefabricated walls and are sufficiently long to protrude through the prefabricated wall; and at least one connecting member having a first receiving member, a second receiving member and a coupling member, the second receiving member coupled to the first receiving member by the coupling member, wherein the first receiving member is secured to the first prefabricated wall by engaging the connectors of the first column member through the openings of the first prefabricated wall, and the second receiving member is secured to the second prefabricated wall by engaging the connectors of the second column member through the openings of the second prefabricated wall.

2. A wall form structure as recited in claim 1 in which the first prefabricated wall comprises a metal mesh extending along a height and a width of the first prefabricated wall and at least one supporting member secured along a height of the metal mesh.

3. A wall form structure as recited in claim 1 in which the first prefabricated wall comprises a screen and a base member, wherein the screen is secured to the base member and is configured to extend along a height and a width of the base member.

4. A wall form structure as recited in claim 3 in which the screen secured to the base member is larger than the base member so that screen boundaries extend beyond the base member and are bent approximately 90 degrees with respect to the base member so that the boundaries are embedded within poured concrete.

5. A wall form structure as recited in claim 1 in which the prefabricated wall comprises a coating material, wherein the coating material is applied onto an outer surface of the prefabricated wall to provide the appearance of a finished wall.

6. A wall form structure as recited in claim 1 in which the first prefabricated wall comprises a base member, a screen and at least one brace;

the base member having a first side and a second side, wherein the screen is secured to the first side along a height and a width of the base member, and the brace, which extends along the height of the base member, is secured to the second side.

7. A wall form structure as recited in claim 6 in which the brace comprises a base, a spine and a plurality of legs that couples the spine to the base;

wherein the base is curved along longitudinal edges to form lips and the legs extend from the spine in an inverted V-shape and are secured to the lips; and the brace further having a plurality of hooks protruding from the base, wherein the hooks penetrate the base member from the second side to the first side and engage the screen.

8. A wall form structure as recited in claim 6 in which the base member comprises at least one track extending along the height of the base member; the track protruding from the base member and sized and shaped to fit the brace thereon.

9. A wall form structure as recited in claim 1 in which the first prefabricated wall comprises a base member and an insulating member, wherein the insulating member extends along a height and a width of the base member and abuts against and secures to the base member.

10. A wall form structure as recited in claim 1 in which the second prefabricated wall comprises a partition member and an insulating member, wherein the partition member and the insulating member extend along a height and a width of the second prefabricated wall, and the insulating member abuts against and secures to the partition member.

11. A wall form structure as recited in claim 10 in which the partition member has a column recess along the openings, wherein the column recess has substantially the same width and depth as the column member.

12. A wall form structure as recited in claim 1 in which the first and second column members are interchangeable.

13. A wall form structure as recited in claim 1 in which each connector comprises at least one indentation to engage the respective receiving member of the connecting member.

14. A wall form structure as recited in claim 1 in which each connector comprises at least one aperture, wherein the connector is secured to the connecting member by a fastening means through the aperture.

15. A wall form structure as recited in claim 14 in which each receiving member has a V-shaped crevice and at least one alignment opening, wherein the crevice comprises a plurality of receptacles to engage the corresponding connecting member therein, and the alignment opening is aligned with the aperture for securing the fastening means there through.

16. A wall form structure as recited in claim 1 in which the coupling member comprises a mesh having openings, wherein the openings are sufficiently small to restrict the flow of concrete, but sufficiently large so that the flow of concrete is not completely restricted.

17. A wall form structure as recited in claim 16 in which the coupling member further comprises at least one cross piece having a first end and a second end, wherein the first end is secured to the first receiving member, and the second end is secured to the second receiving member.

18. A wall form structure as recited in claim 1 in which the coupling member holds a reinforcing bar in a substantially horizontal direction within a space defined by the first and second prefabricated walls.

19. A wall form structure as recited in claim 1 in which at least one first column member is embedded within the first prefabricated wall.

20. A wall form structure comprising:

a plurality of first prefabricated walls coupled together with at least one fastening member, each of the plurality of first prefabricated walls having a plurality of openings;

a plurality of second prefabricated walls coupled together with at least one fastening member, each of the plurality of second prefabricated walls having a plurality of openings;

at least one first column member having a plurality of slits, the first member coupled to the first prefabricated wall;

at least one second column member having a plurality of slits, the second member coupled to the second prefabricated wall; and at least one connecting member having a first receiving member, a second receiving member, and a coupling member, the second member coupled to the first receiving member by the coupling member, wherein the first receiving member is secured to the first prefabricated wall by engaging the first column member through the openings of the first prefabricated wall, and the second receiving member is secured to the second prefabricated wall by engaging the second column member through the openings of the second prefabricated wall.

21. A wall form structure as recited in claim 20 in which the fastening member comprises a wing and two feet coupled to the wing to form an L-shaped member, wherein each foot is inserted into respective incisions of the adjacent column members.

22. A wall form structure comprising:

a first column member having a plurality of connectors;

a second column member having a plurality of connectors;

a first prefabricated wall having a plurality of openings sized to fit the connectors of the first column member;

a second prefabricated wall comprising an inner wall member and an insulation member abutting against the inner wall member, both members having a plurality of openings sized and aligned to fit the connectors of the second column member; and at least one connecting member having a first receiving member, a second receiving member and a coupling member, the second receiving member coupled to the first receiving member by the coupling member, wherein the coupling member comprises a mesh, the first receiving member having a plurality of receptacles sized to fit the corresponding connectors of the first column member and the second receiving member having a plurality of receptacles sized to fit the corresponding connectors of the second column member, wherein the first receiving member is secured to the first prefabricated wall by engaging the connectors of the first column with the first receiving member through the openings in the first prefabricated wall, and the second receiving member is secured to the second prefabricated wall by engaging the connectors of the second column with the second receiving member through the openings in the second prefabricated wall, and wherein the wall form structure defines at least one cavity between the first prefabricated wall and the second prefabricated wall.

23. A wall form structure as recited in claim 22 in which the coupling member comprises at least one cross piece, the cross piece having a first end and a second end, wherein the first end is attached to the first receiving member and the second end is attached to the second receiving member.

24. A wall form structure comprising:

an upright support;

a prefabricated wall;

a fastener having a first end, a second end and a neck, the second end coupled to the first end by the neck;

at least one brace extending along a height of the prefabricated wall and secured to the prefabricated wall;

the brace having a plurality of slits to engage the first end of the fastener;

the first end sized to fit into the slit and rotated therein to engage the brace; and securing means for securing the second end to the upright support.

25. A wall form structure as recited in claim 24 in which the securing means comprises a bracket and a nut;

the bracket having a first piece coupled to a second piece, the first piece having an aperture for the second end of the fastener to protrude, wherein the nut secures the second end to the first piece and the second piece is attached to the upright support.

26. A wall form structure comprising:

a first prefabricated wall having a plurality of openings;

a second prefabricated wall having a plurality of openings;

a plurality of connectors coupled to and extending through the openings of the first and second prefabricated walls, wherein the connectors are sized to fit the openings in the prefabricated walls and are sufficiently long to protrude through the prefabricated wall;

at least one connecting member having a first receiving member, a second receiving member and a coupling member, the second receiving member coupled to the first receiving member by the coupling member, wherein the first receiving member is secured to the first prefabricated wall by engaging the connectors coupled to the first prefabricated wall, and the second receiving member is secured to the second prefabricated wall by engaging the connectors coupled to the second prefabricated wall.

27. A method for constructing a wall form structure comprising the steps of:

forming a first prefabricated wall having a plurality of openings;

forming a second prefabricated wall having a plurality of openings;

forming a first and a second column member each comprising a planar stem member and a plurality of connectors, the planar stem member extending along a height of the respective prefabricated wall, the connectors secured to and extending substantially perpendicular from the planar stem member, wherein the connectors are sized and arranged to fit the corresponding openings in the prefabricated walls and are sufficiently long to protrude through the prefabricated wall;

securing the first column member to the first prefabricated wall through the openings of the first prefabricated wall;

securing the second column member to the second prefabricated wall through the openings of the second prefabricated wall;

forming a connecting member having a first receiving member, a second receiving member and a coupling member, wherein the second receiving member is coupled to the first receiving member by the coupling member;

securing the first receiving member to the first prefabricated wall by engaging the first receiving member to the first column member; and securing the second receiving member to the second prefabricated wall by engaging the second receiving member to the second column member.

28. A method as recited in claim 27, further comprising the steps of embedding the first column member within the first prefabricated wall.

* * * * *